US007093392B2

(12) United States Patent
Derham et al.

(10) Patent No.: US 7,093,392 B2
(45) Date of Patent: Aug. 22, 2006

(54) SPRING BALANCE ADJUSTMENT

(75) Inventors: Mike Derham, Saffron Walden (GB); Michael Hawker, Ipswich (GB)

(73) Assignee: Mighton Products, Limited, Walden (GB)

( * ) Notice: Subject to any disclaimer, the term of this patent is extended or adjusted under 35 U.S.C. 154(b) by 0 days.

(21) Appl. No.: 10/999,569

(22) Filed: Nov. 30, 2004

(65) Prior Publication Data

US 2006/0112642 A1 Jun. 1, 2006

(51) Int. Cl.
*E05F 1/00* (2006.01)

(52) U.S. Cl. ..... 49/445; 49/447

(58) Field of Classification Search ..... 49/161, 49/163, 176, 181, 445, 447; 16/193, 195, 16/201, 400

See application file for complete search history.

(56) References Cited

U.S. PATENT DOCUMENTS

| | | | | |
|---|---|---|---|---|
| 2,041,646 | A | 5/1936 | Larson | |
| 2,304,175 | A | 12/1942 | Jessup | |
| 2,371,366 | A | 3/1945 | Viehweger | |
| 2,415,614 | A | 2/1947 | Tappan | |
| 2,477,069 | A | 7/1949 | Larson | |
| 2,580,705 | A | 1/1952 | Tappan | |
| 2,604,655 | A | 7/1952 | Peremi | |
| 2,774,100 | A | 12/1956 | Larson et al | |
| 2,793,389 | A | 5/1957 | Larson | |
| 2,890,480 | A | 6/1959 | Gregg et al | |
| 2,943,345 | A | 7/1960 | Ammerman | |
| 3,047,905 | A | 8/1962 | Nobes | |
| 3,064,306 | A | 11/1962 | Beasley, Jr. et al. | |
| 3,286,301 | A | 11/1966 | Skolnik | |
| 3,330,071 | A * | 7/1967 | Kubisaik | 49/362 |
| 3,452,478 | A | 7/1969 | Foster | |
| 3,478,348 | A | 11/1969 | Skolnik | |
| 3,609,796 | A | 10/1971 | Skolnik | |
| 4,683,676 | A | 8/1987 | Sterner, Jr. | |
| 4,718,194 | A | 1/1988 | FitzGibbon et al. | |
| 5,152,032 | A | 10/1992 | Davis et al. | |
| 5,157,808 | A | 10/1992 | Sterner, Jr. | |
| 5,267,416 | A | 12/1993 | Davis | |
| 5,353,548 | A | 10/1994 | Westfall | |
| 5,383,303 | A * | 1/1995 | Nakanishi et al. | 49/181 |
| 5,463,793 | A | 11/1995 | Westfall | |
| 6,041,475 | A | 3/2000 | Nidelkoff | |

(Continued)

FOREIGN PATENT DOCUMENTS

| | | |
|---|---|---|
| GB | 348534 | 2/1930 |

(Continued)

OTHER PUBLICATIONS

EPO Search Report under Section 17, Apr. 11, 2003.

*Primary Examiner*—Jerry Redman
(74) *Attorney, Agent, or Firm*—Michelle Saquet Temple; Paul C. Remus

(57) ABSTRACT

In sash windows where the sashes are supported on window units which run in channels in a window frame, and the window units are suspended from spring balances, the shoes have easily accessible mechanisms for adjusting the tension in the spring balances, without demounting the sashes and without separating the spring balances from the shoes. Adjustment is done by rotating an element in the shoes, at the bottom of the sash, with the sash pivoted out of the plane of the window. A tool is inserted in a socket to turn an element of the shoe exposed by the tilting of the sash, and the rotation of this element is transferred through 90° to vary the tension in the respective balance.

8 Claims, 4 Drawing Sheets

U.S. PATENT DOCUMENTS

| | | | | |
|---|---|---|---|---|
| 6,119,398 | A | 9/2000 | Yates, Jr. | |
| 6,948,215 | B1 * | 9/2005 | Malek et al. | 16/197 |

FOREIGN PATENT DOCUMENTS

| | | |
|---|---|---|
| GB | 452680 | 7/1935 |
| GB | 465925 | 5/1936 |
| GB | 679478 | 9/1952 |
| GB | 720858 | 12/1954 |
| GB | 812239 | 4/1959 |
| GB | 819094 | 8/1959 |
| GB | 2 262 123 | 6/1993 |
| GB | 2 373 813 | 10/2002 |

* cited by examiner

SPRING BALANCE ADJUSTMENT

FIELD OF THE INVENTION

This invention relates to the adjustment of spring balances of the type used for supporting sash windows.

BACKGROUND TO THE INVENTION

Spring balances are often used in sash windows, to support or counterbalance the weight of each window sash. A balance is fitted on either side of each sash. The balances work by winding up a helical spring which then produces a frictional engagement between two parts, one connected directly or indirectly to the frame and the other connected directly or indirectly to the sash. The friction is such that the sash will stay put in any position to which it is moved, but can be overcome, so that the sash can be moved, when pushed up or down by an external force. The tension in the springs in the balances have to be set in accordance with the weight of the particular sash being supported. The tension is adjusted by rotating a component of the balance which is to be connected to the sash, while that component is momentarily disengaged from the sash.

This rotation is difficult to do, because access to the relevant component is restricted by the adjacent parts of the window frame. Also it is difficult to adjust the balances on both sides of a window so that they are under equal tension. Still further, readjustment may be necessary after the window has been in use for a period of time.

Sash windows are known where the sashes are supported on slide shoes which slide in channels in vertical window frame members. The sashes are pivotally mounted in these shoes so that the sash can be pivoted out of the plane of the window frame. Such sashes are also provided with secondary fastenings to normally hold the sashes in the window plane, but those secondary fastenings can be released when the window is to be pivoted.

The invention seeks to provide a mechanism which overcomes or reduces the difficulty of spring balance adjustment when slide shoes are used.

SUMMARY OF THE INVENTION

According to the invention, there is provided a slide shoe for a sash window unit, the shoe comprising a body adapted to slide along a channel in a frame of the window unit, a socket in the body for pivotably receiving a boss mounted on a window sash so that the sash can pivot about an axis at right angles to the direction of sliding movement of the shoe in the channel, an attachment point for one end of a spring balance and means for rotating the attachment point to alter the amount of energy stored in a spring balance, when a spring balance is attached to the attachment point.

The means for rotating the attachment point can preferably be operated without detaching the balance from the attachment point, and can have a socket for receiving a tool (such as a screwdriver or Allen key), so that rotation of the tool causes rotation of the attachment point.

The means for rotating the attachment point preferably comprises two meshing bevel gears arranged so that rotation can be applied on a first axis to produce rotation on a second axis substantially perpendicular to the first axis. In a preferred arrangement, both axes are in the plane of the window, the first axis is at right angles to the axis of the spring balance, and the second axis is parallel to the axis of the balance.

The means for rotating the attachment point preferably also includes a ratchet mechanism which permits rotation in one angular direction and prevents rotation in the opposite angular direction. The ratchet mechanism can have two opposed pawls which are spring loaded into contact with a cylindrical ratchet surface which rotates as part of the means for rotating the attachment point.

It may also be possible for the shoe to carry a boss which engages in a socket on the sash frame, to allow pivoting of the sash relative to the window frame. Therefore the invention also provides a slide shoe for a sash window unit, a boss on the body for pivotably entering a socket in a window sash so that the sash can pivot about an axis at right angles to the direction of sliding movement of the shoe in the channel, an attachment point for one end of a spring balance and means for rotating the attachment point to alter the amount of energy stored in a spring balance, when a spring balance is attached to the attachment point.

The invention extends to a sash window unit having a frame and a window sash mounted in the frame and supported on at least one slide shoe as set forth above.

In a particularly preferred embodiment, the slide shoe comprises a molded plastic body having a vertically oriented socket for receiving a cylindrical, rotatable hook member into which an end of a spring balance can be fitted. The bottom end of the hook member carries a bevel gear, and a rotary member with a matching bevel gear is received in the body from one side face, so that the rotary member can be rotated to produce rotation of the hook member.

These aspects of the invention are not meant to be exclusive and other features, aspects, and advantages of the present invention will be readily apparent to those of ordinary skill in the art when read in conjunction with the appended claims and accompanying drawings.

BRIEF DESCRIPTION OF THE DRAWINGS

These and other features and advantages of the present invention will be better understood by reading the following detailed description of preferred embodiments, taken together with the drawings wherein.

DETAILED DESCRIPTION OF THE PREFERRED EMBODIMENTS

Figure 1:
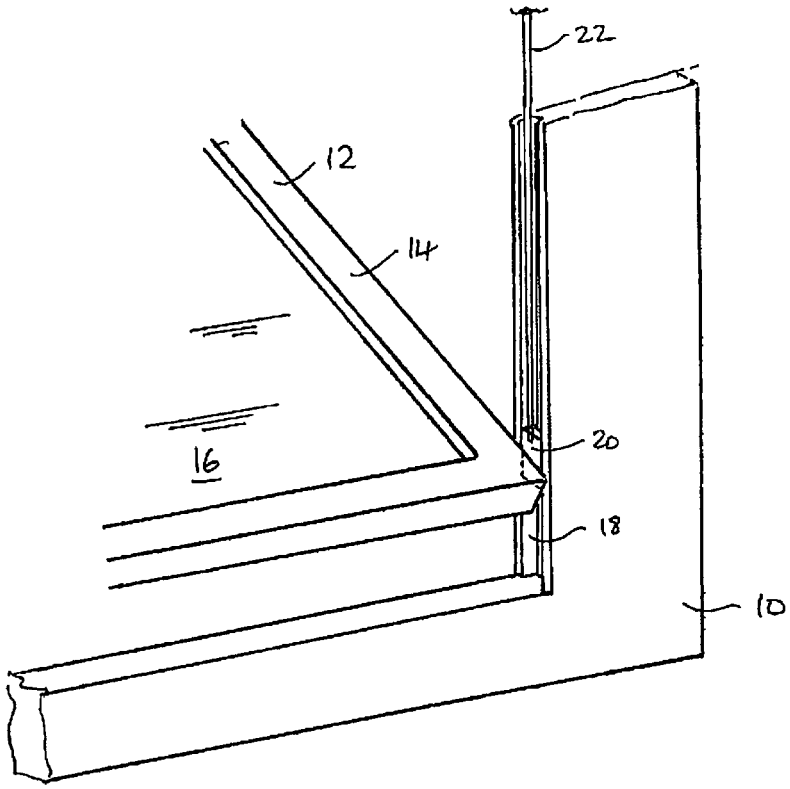
FIG. 1 is a perspective view of part of a window unit in which the invention can be applied.

FIG. 1 shows a section of a window unit consisting of a window frame 10 and a window sash 12 mounted in the frame. The sash 12 itself has a frame 14, and a pane of glass 16 mounted in the frame 14. In FIG. 1, the sash 12 is shown pivoted out of the plane of the window frame 10.

The frame 10 has a vertical channel 18 in which a slide shoe 20 is able to slide vertically. The slide shoe 20 is supported at the lower end of a spring balance 22, and there is a pivotal connection between a point on the lower edge of the sash frame 14, and the shoe 20 which allows the sash (when released from other fastenings) to pivot out of the plane of the window, as shown. It will be appreciated that the normal position for the sash 12 will be to lie within the plane of the frame 10.

The spring balance 22 has to be set for each window unit, so that the force exerted by the balance on the shoe 20 (acting in an upwards direction) substantially balances the weight of the sash which acts on the shoe 20 in a downward direction. The weight of the sash depends of course upon the dimensions of the sash itself and on the weight of the glass pane 16 which may, for example, be single glazed or double glazed. It is therefore necessary to adjust the force exerted by the balance 22 on the shoe 20, once the unit has been assembled, in order to achieve the correct operation of the window sashes.

Spring balances of this type, as is known, store energy by winding up a spring in the balance. The top end of the spring is fixed and the bottom end is rotated about the axis of the balance to increase or decrease the friction between a twisted flat rod which slides into and out of a disc with a flat section aperture and which is biased by a helical spring. Rotating the rod varies the force which the balance exerts. Once the necessary adjustment has taken place, the lower end of the balance is held in the shoe so that it cannot rotate any further.

The shoe 20 of this invention is designed so that the tension in the spring balance can be adjusted while the sash 12 is in place and without dismounting any components.

The shoe comprises a skeletal, molded plastics body 24. The body can be molded from acetal. The body has a transverse socket 26 for receiving a pin on a corner of the sash frame 14 so that the sash can (once released from other fastenings elsewhere on the frame) pivot to the position shown in FIG. 1. It may alternatively be possible for the shoe to have a pin which engages in a socket in the sash frame 14 to provide the same functionality.

The shoe body 24 also has a cylindrical axial recess 28, and an attachment member 30 is adapted to fit in this recess 28 and to rotate within the recess. The attachment member 30 has a forked upstand 32 with a slot 34, into which the bottom end of the spring balance can be attached. The bottom end of the spring balance is conventionally a flat strip with a fixed transverse pin which engages in an undercut groove 36 on the attachment member 30.

Figure 2:
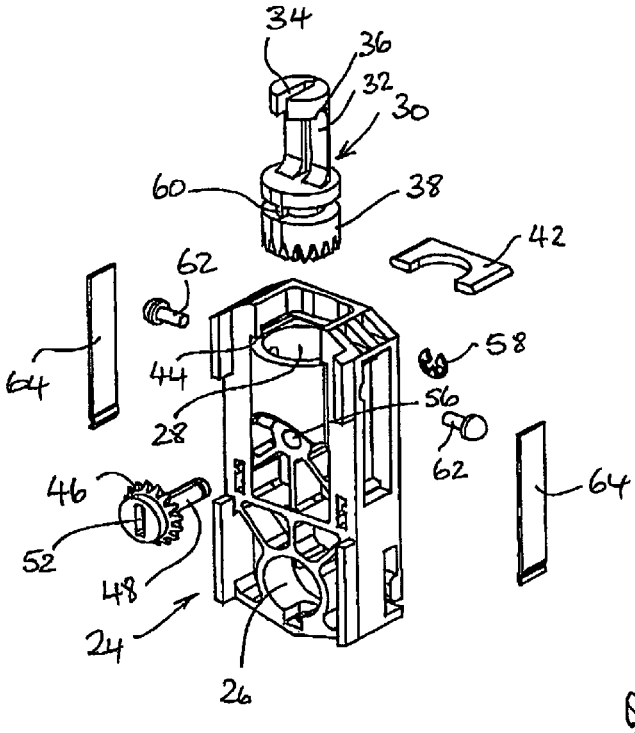
FIG. 2 is an exploded, perspective view of a slide shoe in accordance with the invention.
Figure 3:
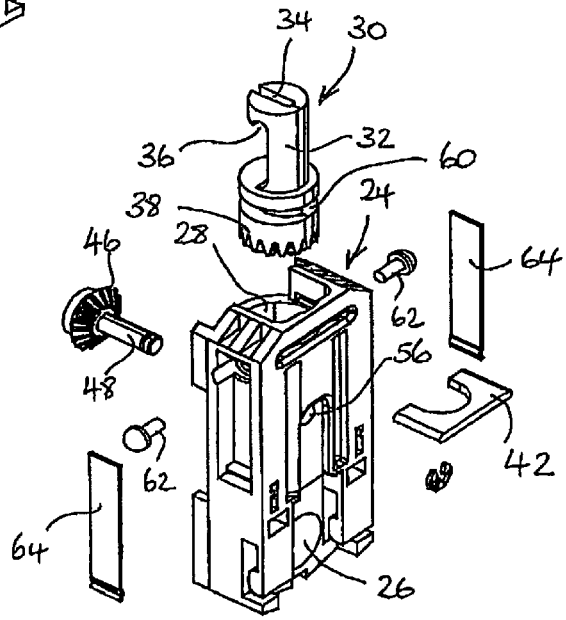
FIG. 3 is another exploded perspective view of the shoe of FIG. 2, seen from the opposite side.

Bevel gear teeth 38 (with the gear face hidden from view in FIGS. 2 and 3) are formed on the underside of the attachment member 30. The attachment member 30 with its bevel gear teeth 38 is then received in the recess 28 and held there by a top plate 42 which engages in undercut grooves 44.

A meshing bevel gear 46 is mounted on a gear shaft 48. The gear 46 has a slot 52 which is able to accept the blade of a screwdriver. The gear and shaft assembly 46, 48 is then inserted and held in place of the shaft 48. In this position, the bevel gearing on the gears 38 and 46 mesh with one another, so that rotation of the bevel gear 46 leads to rotation of the attachment member 30, about a vertical axis.

A ratchet mechanism operates between the body 24 and the attachment member 30, so that rotation is only allowed in one direction. The attachment member 30 has ratchet teeth at 60, and ratchet pins 62 are mounted in the sides of the body 24, to project into the annular groove on the attachment member where the ratchet teeth are positioned. The pins 62 are biased inwardly by leaf springs 64.

All these components are shown assembled in FIGS. 4 to 10.

Figure 4:
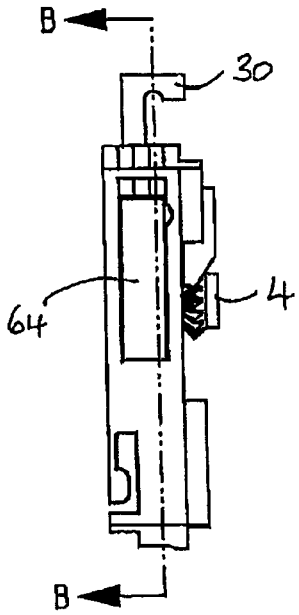
FIG. 4 is a side view of the shoe.
Figure 6:
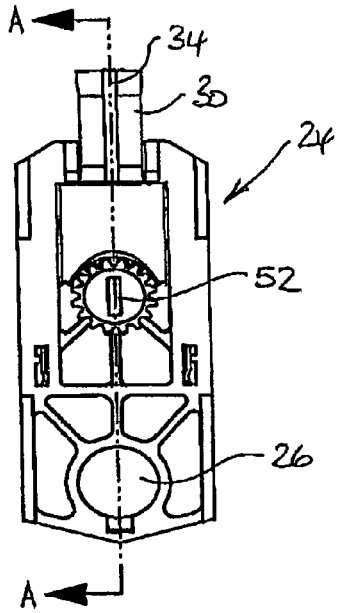
FIG. 6 is a front view of the shoe.
Figure 5:
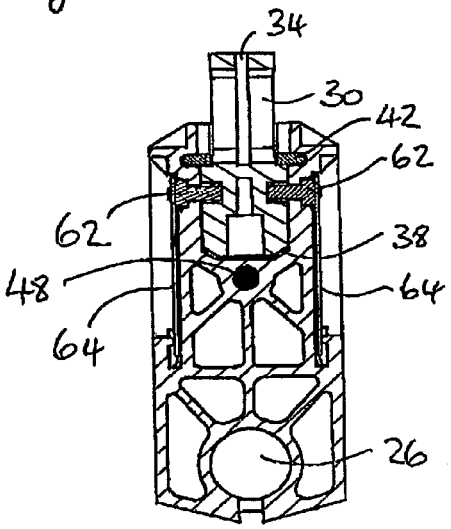
FIG. 5 is a section on the line B—B from FIG. 4.
Figure 7:
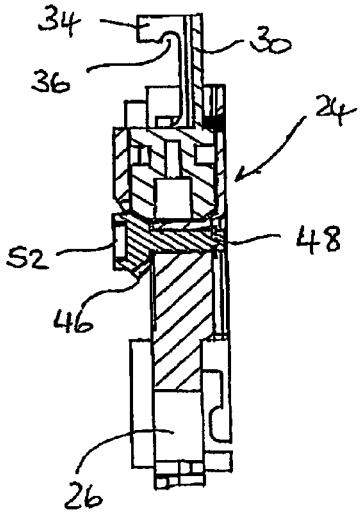
FIG. 7 is a section on the line A—A from FIG. 6.
Figure 9:
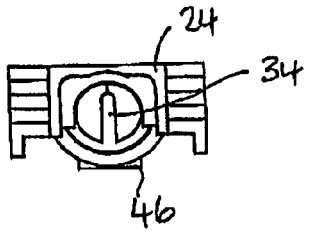
FIG. 9 is a top view.
Figure 8:
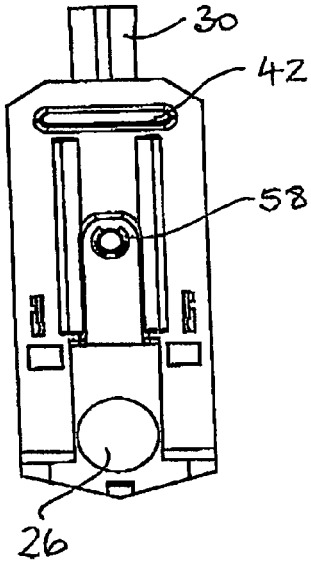
FIG. 8 is a rear view of the shoe.
Figure 10:
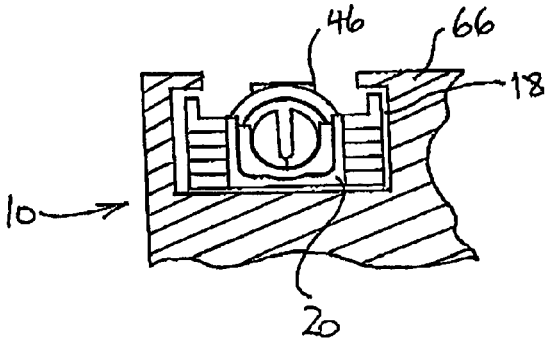
FIG. 10 is an underneath view of the shoe, showing schematically part of the window frame.

FIGS. 4 and 6 show the screwdriver slot 52. FIG. 7 shows the bevel gears 46 and 38 in mesh. FIG. 5 shows the ratchet pins 62 and their springs 64 engaging with the ratchet teeth 60. FIG. 10 shows a schematic cross-section through part of the frame 10, showing the channel 18 which, in practice, has a depth which extends behind the front face 66 sufficiently far that the bevel gear 46 does not interfere with sliding movement of the sash up and down the face 66 of the frame.

Although not shown in FIG. 1, with the sash in the pivoted position shown the bevel gear 46 will be exposed so that a screwdriver can be placed in the slot 52 and turned to increase the energy stored in the spring balance 22 and thus to increase the upward force applied by the balance 22.

In practice balances are usually supplied with no tension in them. Once the sashes have been installed in a window frame, the balances need to be tightened until they exert an amount of force as required to balance the weight of the sash. In the unlikely event that tension needs to be released, the lower end of the balance will need to be detached from the attachment member 30. Once it is reattached after tension has been released, it will be easy to tighten it again to the correct setting.

The ratchet portion 60 of the attachment member 30 can have any suitable number of teeth, but generally two or three teeth is all that is required to provide the necessary stepwise setting of the spring balance tension.

Whilst the body 24 will be of molded plastic, the other components may be of plastics or metal, depending on the conditions under which they will work. In particular, the attachment member 30 and the gear and shaft 46,48 can be made of metal to produce the right combination of strength and hardness. These components can be made by metal injection molding (MIM).

The use of this slide shoe enables spring balances to be very easily and accurately adjusted, thus saving a great deal of time and aggravation in the installation and setting up of sash window units.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

The invention claimed is:

1. A slide shoe for a sash window unit, the shoe comprising:

a body adapted to slide along a channel in a frame of the window unit;

a socket in the body for pivotably receiving a boss mounted at the bottom of a window sash so that the sash can pivot about an axis at right angles to the direction of sliding movement of the shoe in the channel;

an attachment point for one end of a spring balance; and means for rotating the attachment point to alter the amount of energy stored in a spring balance, when a spring balance is attached to the attachment point, wherein the means for rotating the attachment point comprises two meshing bevel gears arranged so that rotation can be applied on a first axis to produce rotation on a second axis substantially perpendicular to the first axis, wherein both axes are in the plane of the window, the first axis is at right angles to the axis of the spring balance, and the second axis is parallel to the axis of the spring balance, and wherein the means for rotating the attachment point comprising a ratchet mechanism that permits rotation in one angular direction and prevents rotation in the opposite angular direction, and wherein the ratchet mechanism has two opposed pawls that are spring loaded into contact with a cylindrical ratchet surface that rotates as part of the means for rotating the attachment point.

2. The slide shoe of claim 1 wherein the means for rotating the attachment point can be operated without detaching the balance from the attachment point.

3. The slide shoe of claim 1 wherein the means for rotating the attachment point has a socket for receiving a tool, so that rotation of the tool causes rotation of the attachment point.

4. The slide shoe of claim 3 wherein the tool is a screwdriver.

5. A sash window unit comprising:

a frame; and a window sash mounted in the frame and supported on at least one slide shoe, the shoe comprising:

a body adapted to slide along a channel in a frame of the window unit;

a socket in the body for pivotably receiving a boss mounted at the bottom of a window sash so that the sash can pivot about an axis at right angles to the direction of sliding movement of the shoe in the channel;

an attachment point for one end of a spring balance; and means for rotating the attachment point to alter the amount of energy stored in a spring balance, when a spring balance is attached to the attachment point, wherein the means for rotating the attachment point comprises two meshing bevel gears arranged so that rotation can be applied on a first axis to produce rotation on a second axis substantially perpendicular to the first axis, wherein both axes are in the plane of the window, the first axis is at right angles to the axis of the spring balance, and the second axis is parallel to the axis of the spring balance, and wherein the means for rotating the attachment point comprises a ratchet mechanism that permits rotation in one angular direction and prevent rotation in the opposite angular direction, and wherein the ratchet mechanism has two opposed pawls that are spring loaded into contact with a cylindrical ratchet surface that rotates as part of the means for rotating the attachment point.

6. The window unit of claim 5 wherein the means for rotating the attachment point can be operated without detaching the balance from the attachment point.

7. The window unit of claim 5 wherein the means for rotating the attachment point has a socket for receiving a tool, so that rotation of the tool causes rotation of the attachment point.

8. The window unit of claim 7 wherein the tool is a screwdriver.

* * * * *